US007207740B1

(12) United States Patent
Baggett

(10) Patent No.: US 7,207,740 B1
(45) Date of Patent: Apr. 24, 2007

(54) STACKED PAPER FASTENER

(76) Inventor: R. Sherman Baggett, 3517 Coolheights Dr., Rancho Palos Verdes, CA (US) 90275

( * ) Notice: Subject to any disclaimer, the term of this patent is extended or adjusted under 35 U.S.C. 154(b) by 483 days.

(21) Appl. No.: 10/856,478

(22) Filed: Jun. 1, 2004

(51) Int. Cl.
*B42F 13/02* (2006.01)
*B42F 13/06* (2006.01)
*B42F 13/12* (2006.01)
*B42F 13/36* (2006.01)
*B42F 3/00* (2006.01)

(52) U.S. Cl. ..... 402/8; 402/14; 402/60; 402/63

(58) Field of Classification Search ..... 281/28, 281/15.1, 21.1, 27.3; 402/13, 14, 15, 17, 402/2, 5, 8, 49, 55, 60, 63, 64, 70, 71, 73, 402/80 R, 500, 502; 24/67.3, 67.5, 67.9, 24/67.11, 67 R, 901; D19/32, 33, 65
See application file for complete search history.

(56) References Cited

U.S. PATENT DOCUMENTS 1,249,929 A * 12/1917 Dustan ..... 402/49
1,342,637 A * 6/1920 McMillan ..... 402/5
2,314,532 A * 3/1943 Wagner ..... 402/15
3,537,146 A * 11/1970 Caveney ..... 24/16 PB
4,070,736 A * 1/1978 Land ..... 402/15
4,121,892 A * 10/1978 Nes ..... 402/17
4,305,675 A * 12/1981 Jacinto ..... 402/61
4,309,046 A * 1/1982 Giulie ..... 281/21.1
4,875,793 A * 10/1989 Deem ..... 402/3
5,096,323 A * 3/1992 Walker ..... 402/62
5,257,870 A * 11/1993 Bennett et al. ..... 402/63
5,265,968 A 11/1993 Atkins ..... 402/63
5,338,126 A * 8/1994 Mullin et al. ..... 402/64
5,425,592 A * 6/1995 Mullin et al. ..... 402/64
5,988,925 A * 11/1999 Baggett ..... 402/8
6,793,435 B2 * 9/2004 Higashino et al. ..... 402/8
2002/0141809 A1 * 10/2002 Higashino et al. ..... 402/8
2004/0052572 A1 * 3/2004 Peters ..... 402/60

* cited by examiner

*Primary Examiner*—Monica Carter
*Assistant Examiner*—Pradeep Battula
(74) *Attorney, Agent, or Firm*—Kenneth L. Green; Edgar W. Averill, Jr.

(57) ABSTRACT

A paper fastener has a base piece with a pair of prongs which may be passed through a pair of keyed slots in a top piece and latched to the top piece to hold stacked papers together. Two latching covers hingedly extend from ends of the top piece. The prongs are folded inwardly against the top piece and the latching covers are folded over the prongs, and the prongs and the latching covers are engaged on a top surface of the top piece. Second teeth on downward facing sides of the folded latching covers engage first teeth on upward facing surfaces of the folded prongs, thereby preventing the prongs from sliding back through the keyed slots. The base piece and the top piece are disconnected by first releasing the latching covers, and then releasing the prongs, so that the top piece can be easily removed to add more pages to a stack of papers or to disassemble the stack of papers.

18 Claims, 7 Drawing Sheets

12
24

25

16
35
34
38
H2

36
37
4

W1
W2
28
5

S
H1
H3

L

STACKED PAPER FASTENER

BACKGROUND OF THE INVENTION

The present invention relates to office supplies and the invention relates more particularly to fasteners for securing a stack of documents or papers together by passing a pair of prongs through a spaced apart pair of holes near the top edge or side edge of each sheet of paper.

Known fasteners are typically referred to by a well know trademark of "Acco Fasteners." Such fasteners have a horizontal lower piece with a pair of thin metal prongs which may be oriented vertically, and a top piece for securing the metal prongs. The papers are secured by laying the papers over the fastener wherein the prongs pass through spaced apart holes in the papers. Next, the top piece is placed over the prongs and over the stack of paper, and the prongs are bent over the top piece and affixed to the top piece to secure the papers in place. Large stack of papers fastened with the known "Acco Fasteners", which typically utilize thin metal prongs, are notorious for becoming unfastened, and edges of the thin metal prongs are know to cuts fingers or hands if not carefully handled.

Because of the unreliability and possibility of cuts from the thin metal fasteners, attempts have been made to make fasteners which are fabricated from plastic. One such fastener is described in U.S. Pat. No. 5,096,323 for "Prong Type Stacked Paper Fastener," which includes a pair of prongs which fit through openings in a top piece. The prongs include a series of longitudinally spaced apart holes therethrough, and the top piece includes locking tang means which engage the holes in the prongs. The prongs are then folded over and secured by slide locks on the top piece. Because the holes are spaced at discreet distances, the prongs can only be tightened in discreet steps, and therefore papers are often held loosely in such fasteners. Such loose holding of papers invites tearing and loss of papers.

U.S. Pat. No. 5,257,870 for "Paper retaining Means," shows a paper fastener which has a pair of notched prongs which pass vertically through a top piece, and then bend to a horizontal attitude and are retained under first and second clipping parts. Because it is necessary to feed the prongs through a confined space under the clipping parts, releasing the prongs requires two fingers. Furthermore, once the prongs are under the clipping parts, they cannot readily be tightened.

U.S. Pat. No. 5,265,968 for "File Clip," describes a fastener comprising a base component having two elongated flexible members extending therefrom. The members are flexible in a direction orthogonal to the base. Papers are slid over the members, and then the members are fed through apertures in a retaining component. Internal teeth in the retaining component engage teeth on the members to retain the members in the retaining component. The fastener of the '968 patent appears to be a very expensive to manufacture due to the number of details in the design, and not easy to manipulate. Further, the members appear to flap freely after insertion through the retaining component, thus frustrating stacking of fastened papers.

BRIEF SUMMARY OF THE INVENTION

The present invention addresses the above and other needs by providing a paper fastener having a base piece with a pair of prongs which may be passed through a pair of keyed slots in a top piece and latched to the top piece to hold stacked papers together. The fastener is preferably entirely made of plastic with no sharp edges so that it cannot readily cut a user. Two latching covers hingedly extend from ends of the top piece. The prongs are folded inwardly against the top piece and the latching covers are folded over the prongs, wherein the prongs and the latching covers are retained in the folded positions by engaging locking surfaces on the top of the top piece. Second teeth on downward facing sides of the folded latching covers engage first teeth on upward facing surfaces of the folded prongs, thereby preventing the prongs from sliding back through the top piece keyed slots. The base piece may be released from the top piece by first releasing the latching covers, and then releasing the prongs, so that the top piece can be easily removed to add more pages to a stack of papers or to disassemble the stack of papers.

In accordance with one aspect of the invention, there is provided a paper fastener comprising two prongs having longitudinally spaced apart teeth, a base piece, and a top piece. The top piece includes a top surface, top piece keyed slots for providing passage of the prongs through the top piece, latching covers hingedly extend from ends of the top piece and including second longitudinally spaced apart teeth, and first and second locks. The first locks are first vertically engaged locks for retaining the prongs against the top surface. The second locks comprise second vertically engaged locks for retaining the latching covers against the prongs. The prongs may be passed through holes in the paper, through the top piece keyed slots in the top piece, and engaged into the locks, thereby sandwiching the paper between the base piece and the top piece. The second longitudinally spaced apart teeth engage the longitudinally spaced apart teeth thereby laterally coupling the prongs to the latching covers to prevent the prongs from sliding back through the top piece keyed slots. The base piece preferably includes base piece keyed slots for attachment of the prongs to the base piece. The slots in the base accept replaceable prongs which prongs may be provided in various lengths. The various length replaceable prongs allow the fastener to bind different height stacks of documents or papers by selecting suitable length prongs.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

Figure 1A:
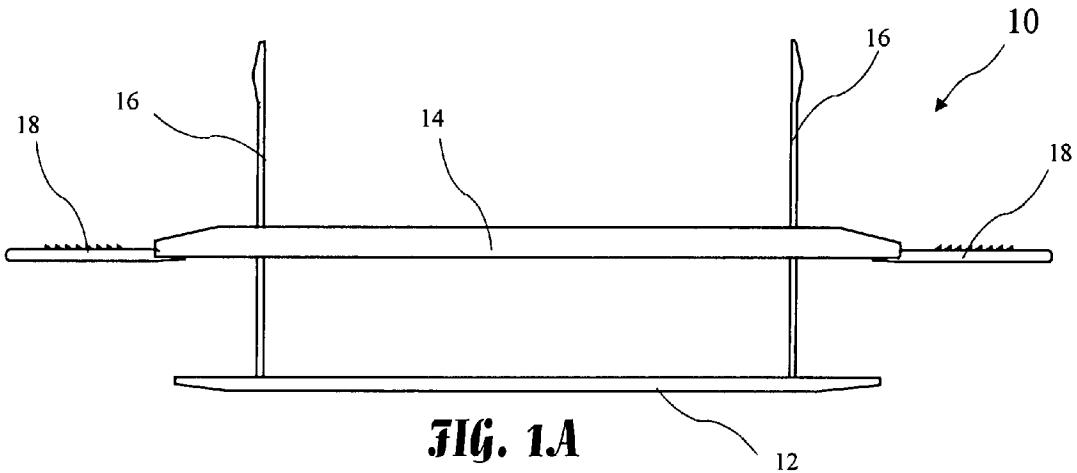
FIG. 1A is a side view of a paper fastener according to the present invention with prongs inserted through keyed slots in a top piece.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

The present invention is a paper fastener 10 as shown in FIGS. 1A–1F. The paper fastener 10 is shown generally in FIG. 1A with prongs 16 extending approximately orthogonally (or vertically as shown) from a base 12. The prongs 16 pass through a top piece 14 including latching covers 18. The paper fastener 10 is used by sliding papers, or stacks of papers, over the prongs 16, and then sliding the top piece 14 over the prongs on top of the papers.

Figure 1B:
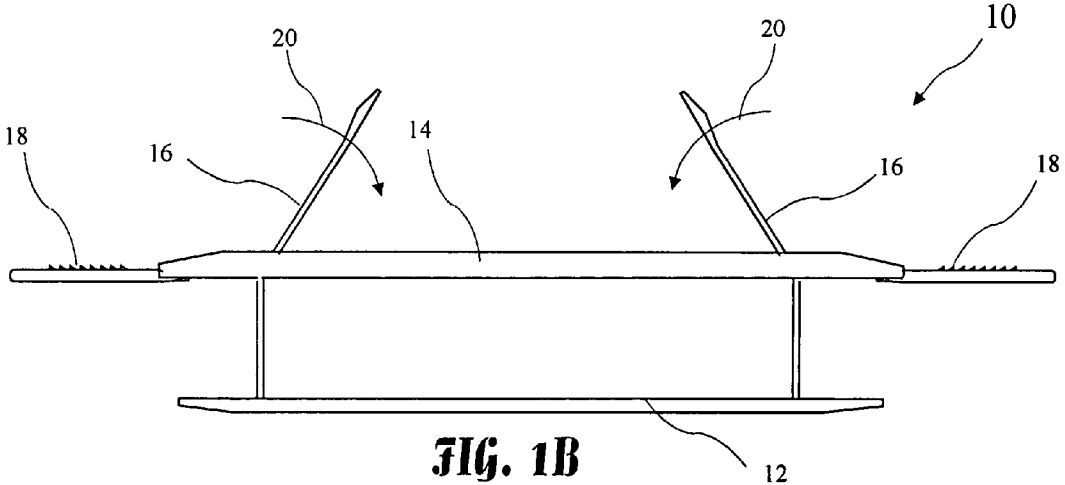
FIG. 1B shows the paper fastener with the prongs partially folded inwardly.
Figure 1C:
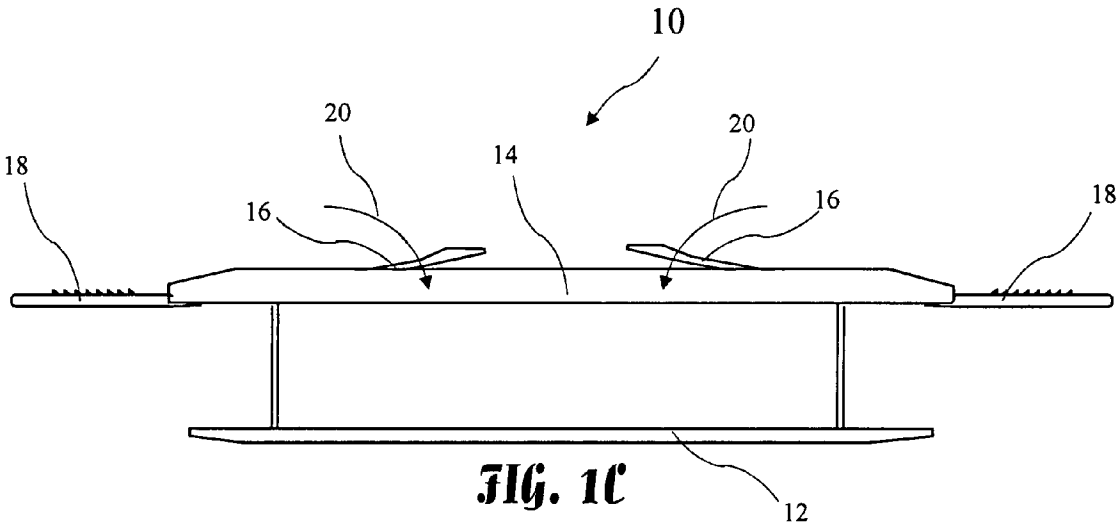
FIG. 1C shows the prongs nearly completely folded against the top piece.
Figure 1D:
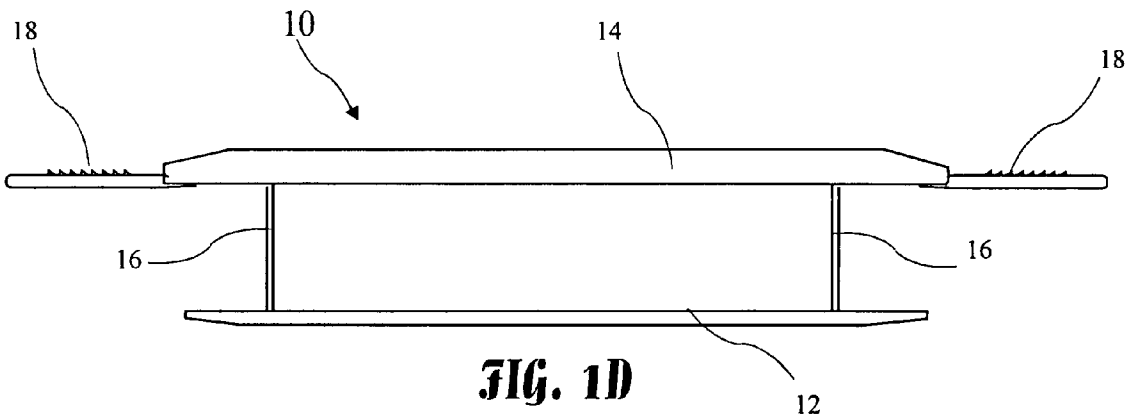
FIG. 1D shows the prongs completely folded against the top piece.

After sliding the top piece 14 over the prongs 16, the prongs 16 are folded over the top piece 14 along arcs 20 as shown in FIG. 1B. The prongs 16 are further folded as shown in FIG. 1C, and finally laid flat against a top surface of the top piece 14 as shown in FIG. 1D. The prongs 16 are then engaged into vertically engaging locks 32*a* (see FIGS. 7A, 7B).

Figure 1E:
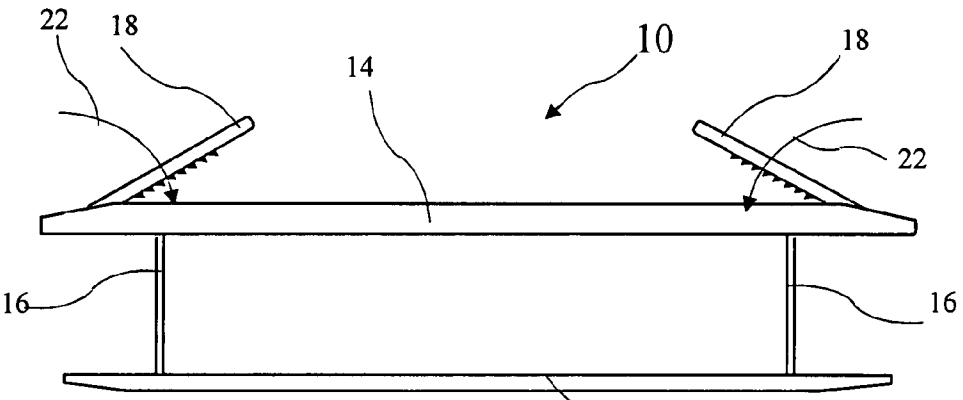
FIG. 1E shows the latching covers partially folded over the prongs.
Figure 1F:
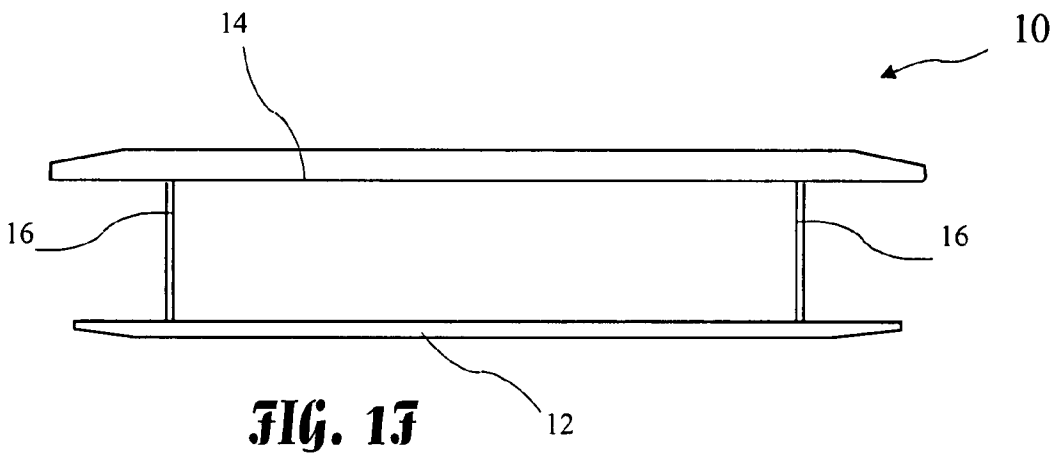
FIG. 1F shows the latching covers completely folded over the prongs.

Next, the latching covers 18 are folded over the prongs 16 along arcs 22 as shown in FIG. 1E, and finally the latching covers 18 are folded flat against the prongs 16 as shown in FIG. 1F. The latching covers 18 are then engaged into second vertically engaging locks 32*b* (see FIGS. 7A, 7C).

Figures 2A, 2B, 2C, 3A, 3B, 3C, 3D, 4, 5, 5A:
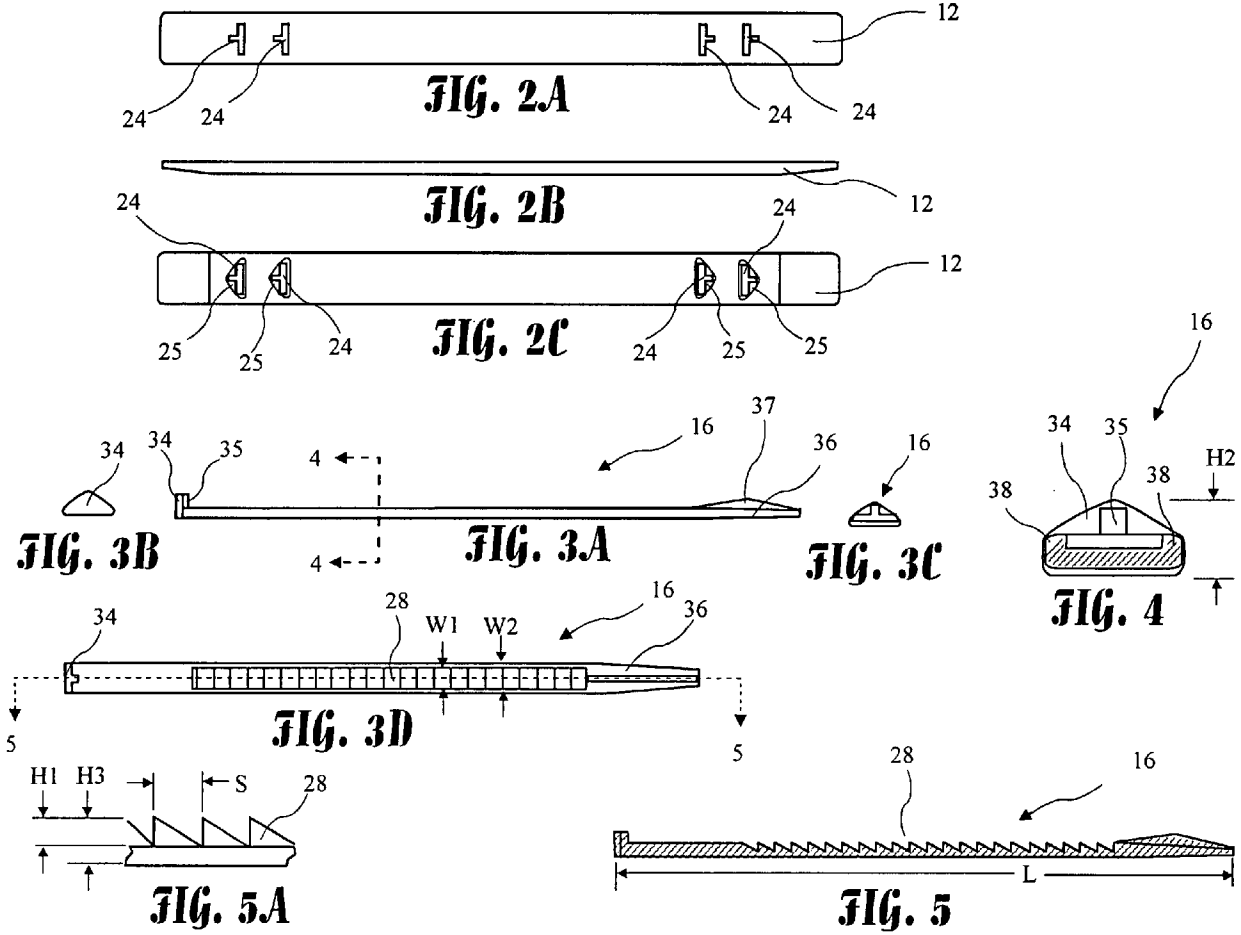
FIG. 2A shows a top view of a base of the present invention.
FIG. 2B shows a side view of the base.
FIG. 2C shows a bottom view of the base.
FIG. 3A is a side view of one of the prongs.
FIG. 3B is a end view of a base of one of the prongs.
FIG. 3C is an end view of a tapered end of one of the prongs.
FIG. 3D is a top view of one of the prongs.
FIG. 4 is a cross-sectional view taken along line 4—4 of FIG. 3A.
FIG. 5 is a cross-sectional view taken along line 5—5 of FIG. 3D.
FIG. 5A is a detailed view of a portion of the cross-sectional view taken along line 5—5 of FIG. 3D.

A top view of the base 12 is shown in FIG. 2A, a side view in FIG. 2B, and a bottom view in FIG. 2C. The base 12 includes at least two base piece keyed slots 24, and preferably four base piece keyed slots 24. The keyed slots 24 are spaced to match the spacing customarily used for hole punched papers, for example, approximately 2.75 inches for holes in the top of a page, or approximately 8.5 inches for holes along the edge of a page. However, other spacing may be used as needed. The keyed slots 24 are preferably Tee shaped and cooperate with the end key 37 (see FIG. 3A,) and thereby insure that the prongs 16 are correctly inserted through the base 12, although other shaped slots, for example simple rectangular slots, may be used as well. Although keyed slots are described herein for aligning the prongs, a stacked paper fastener including any means for aligning the prongs is intended to come within the scope of the present invention.

The base 12 further includes recesses 25 on the base bottom, which recesses 25 accept flanged base 34 (see FIG. 3B) thus allowing the prong 16 to reside flush with the base 12 bottom (see FIGS. 1A–1F).

A side view of one of the prongs 16 having flanged base 34, a base key 35, a tapered end 36, and end key 37, is shown in FIG. 3A. The flanged end 34 is provided to cooperate with the base 12 to establish the position of the flange 16 relative to the base 12 when the flange 16 is inserted through one of the keyed slots 24.

An end view of the flanged base 34, is shown in FIG. 3B. An end view of the tapered end 36 of one of the prongs 16 is shown in FIG. 3C. A top view of one of the prongs is shown in FIG. 3D. The prong 16 width W1 is preferably approximately 0.2 inches. The width W2 of the teeth 28 is preferably approximately 0.125 inches.

A cross-sectional view of one of the prongs 16, taken along line 4—4 of FIG. 3A is shown in FIG. 4. The edges 38 both protect the teeth 28 from damage and protect a user from being cut by the teeth 28, wherein the teeth 28 are approximately even with or below the edges 38 sufficiently to provide said protection. The height H2 of the flanged base 34 is preferably approximately 0.15 inches.

A cross-sectional side view of one of the prongs 16 taken along line 5—5 of FIG. 3D is shown in FIG. 5. The first teeth 28 preferably have a saw-tooth shape, i.e., have a vertical part, and a diagonal part. A detailed view of a short section of one of the prongs 16 is shown in FIG. 5A. Consecutive teeth are spaced S tip-to-tip, wherein S is preferably approximately 0.062 inches. The height H1 of the teeth is preferably approximately 0.03 inches, and the height H3 of the teeth and supporting structure is preferable approximately 0.05 inches. The length L of the prongs is preferably between approximately two inches and approximately three inches, and is selected to match paper stack thickness plus the added length required to engage locks in the top piece 14.

Figure 6A:
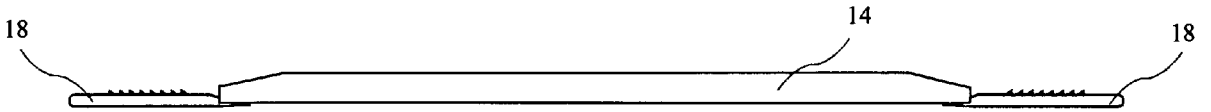
FIG. 6A is a side view of the top piece.
Figure 6B:
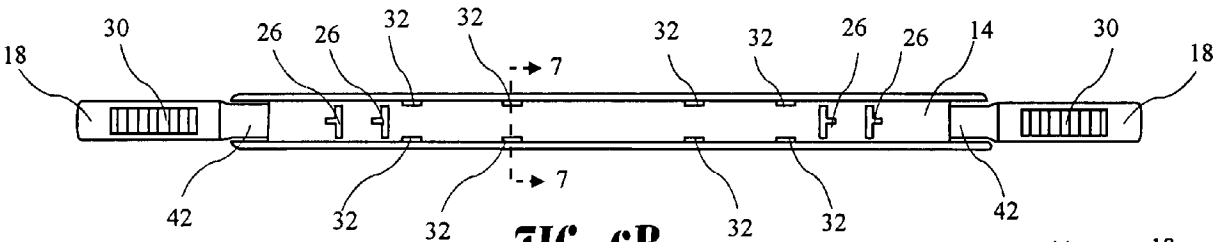
FIG. 6B is a top view of the top piece.
Figure 6C:
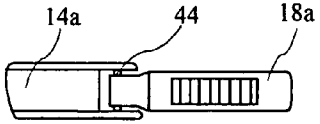
FIG. 6C shows an embodiment of the top piece having pivoting or pinned latching ends.

A side view of the top piece 14 is shown in FIG. 6A, and a top view is shown in FIG. 6B. The top piece 14 includes at least four vertically engaging locks 32, and at least two top piece keyed slots 26, and preferably four keyed slots 26. The latching covers 18 hingedly extend from each end of the top piece 14, and are preferably connected to the top piece 14 by living hinge portions 42. In another embodiment shown in FIG. 6C, a second latching cover 18*a* is hingedly attached to a second top piece 18*a* by a pivot pin 44.

Figure 7C:
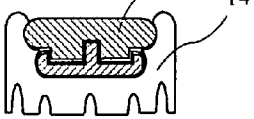
FIG. 7C is the cross-sectional view taken along line 7—7 of FIG. 6B with one of the prongs engaged into a first lock and one of the latching covers engaged into a second lock.
Figure 7B:
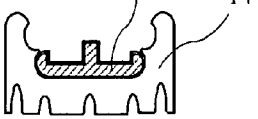
FIG. 7B is the cross-sectional view taken along line 7—7 of FIG. 6B with one of the prongs engaged into a first lock.
Figure 7A:
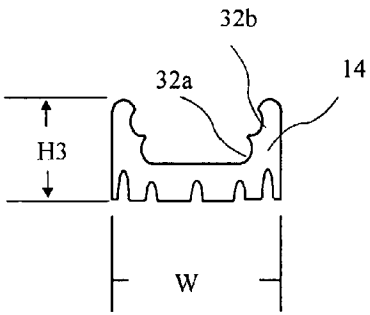
FIG. 7A is a cross-sectional view taken along line 7—7 of FIG. 6B.

FIG. 7A is a cross-sectional view taken along line 7—7 of FIG. 6B showing vertically engaged locks 32*a* and 32*b*. The vertically engaged locks 32*a* and 32*b* include curved surfaces curving upwardly and inwardly past center, thereby engaging both the prong 16 and/or the latching cover 18 when either the prong 16 and the latching cover 18 are pressed downwardly (i.e., vertically) into the vertically engaged locks 32*a* and 32*b* respectively. The width W of the top piece 14 at the cross-section 7—7 is preferably approximately 0.4 inches, and the third height H3 of the top piece 14 at the cross-section 7—7 is preferably approximately 0.175 inches.

A second cross-sectional view taken along line 7—7 of FIG. 6B is shown in FIG. 7B with one of the prongs 16 engaging the vertically engaged locks 32*a*. A third cross-sectional view taken along line 7—7 of FIG. 6B is shown in FIG. 7C with one of the prongs 16 engaging the vertically engaged locks 32*a* and with one of the latching covers 18 engaging the second vertically engaged locks 32*b*.

Figure 8:
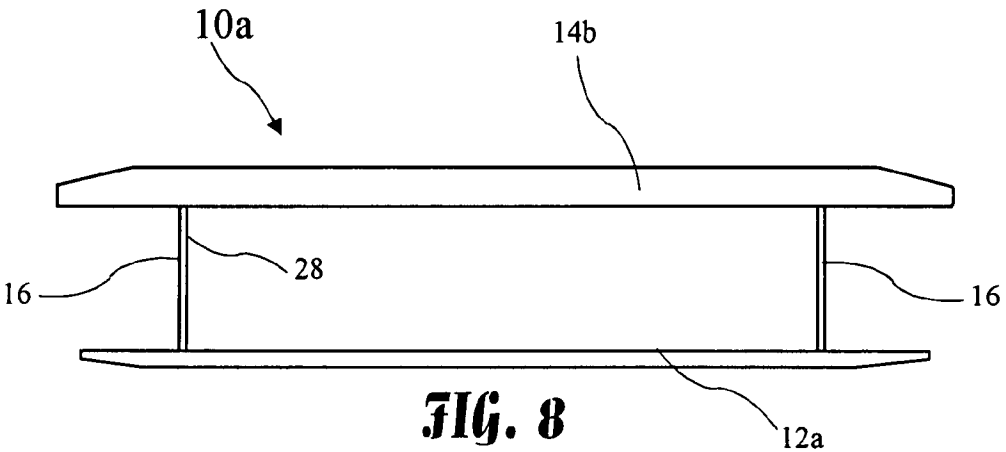
FIG. 8 shows a second embodiment of the paper fastener without latching covers.
Figure 9:
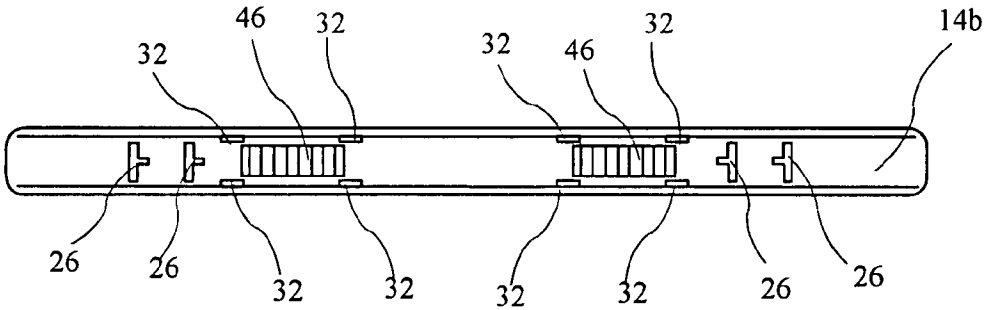
FIG. 9 shows a top view of a third top piece without latching members.

Another embodiment of the paper fastener 10*a* is shown in FIG. 8. The prongs 16 are turned 180 degrees so that the teeth 28 are on the inside facing each other, and a third top piece 14*b* does not have latching covers. A top view of the top piece 14*b* is shown in FIG. 9. The keyed slots 26 point toward the center of the top piece 14*b*, and third teeth 46 reside inwardly from the keyed slots 26. The top piece 14*b* is slid over the prongs 16, and the prongs 16 are folded inwardly against the top surface of the top piece 14*b*. The prongs 16 engage the locks 32, and the teeth 28 on the prongs 16 engage the teeth 46 on the top piece 14*b*, thereby preventing the prongs 16 from pulling back through the keyed slots 26.

Figure 10:
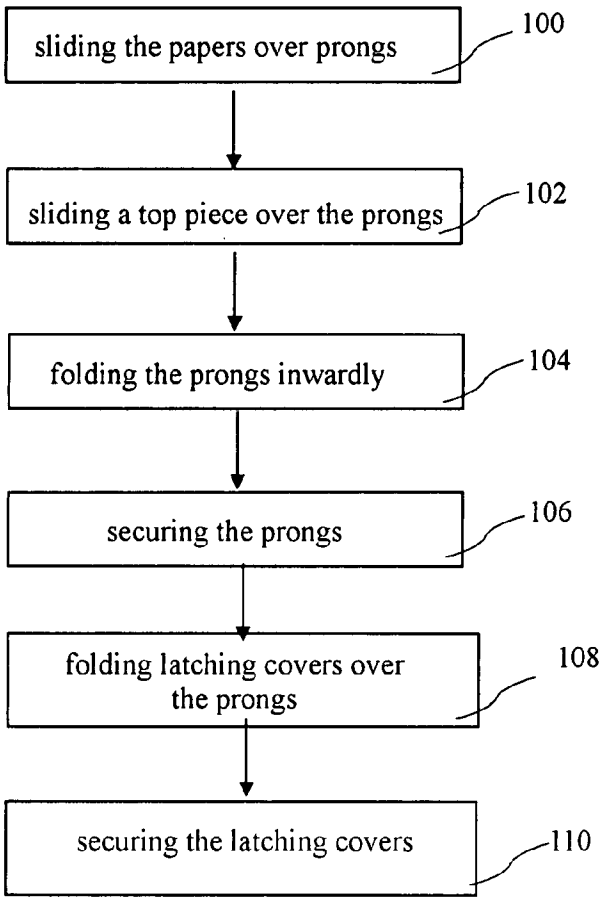
FIG. 10 describes a method of use of the present invention.

A method for fastening paper according to the present invention is described in FIG. 10. The papers are slid over the prongs 16 at step 100. The top piece 14 is slid over the prongs 16 at step 102. The prongs 16 are folded inwardly against the top piece 14 at step 104. The prongs 16 are secured into the locks 32*a* at step 106. The latching covers 18 are folded over the prongs 16 at step 108. The latching members 18 are secured into the locks 32*b* at step 110. An additional initial step may be to insert the prongs 16 through the base 12.

While the invention herein disclosed has been described by means of specific embodiments and applications thereof, numerous modifications and variations could be made thereto by those skilled in the art without departing from the scope of the invention set forth in the claims.

I claim:

1. A paper fastener comprising:

a base piece;

two prongs which are approximately orthogonally extending from the base piece, the prongs having first longitudinally spaced apart teeth; and a top piece having a top surface, the top piece including top piece slots for providing passage of the prongs through the top piece, and vertically engaged locks including curved surfaces curving past center for retaining the prongs against the top surface, wherein the prongs may be passed through holes in the paper, through the top piece slots in the top piece, and engaged into the locks, thereby sandwiching the paper between the base piece and the top piece.

2. The paper fastener of claim 1, wherein the vertically engaged locks further comprise a multiplicity of spaced apart vertically engaged locks.

3. The paper fastener of claim 1, wherein prongs include edges on each side of the first longitudinally spaced apart teeth, and wherein the first longitudinally spaced apart teeth are approximately even with or below the edges.

4. The paper fastener of claim 1, wherein the base piece includes two pairs of base piece slots, and wherein the prongs pass through one of each of said two pairs of base piece slots and said prongs include flanged bases opposite tapered ends, wherein the prongs are attachable to the base piece by inserting the tapered ends through the base piece slots in the base.

5. The paper fastener of claim 4, wherein the base piece keyed slots are Tee shaped keyed slots, and wherein the prongs include center sections between the tapered ends and the flanged bases, and wherein the center sections have a Tee shaped cross-section.

6. The paper fastener of claim 1, wherein the top surface of the top piece includes third teeth, and wherein when the prongs are retained by the vertically engaged locks, the first teeth on the prongs engage the third teeth on the top surface.

7. A method for holding a stack of papers, the method comprising:

sliding the papers over prongs, wherein the prongs are approximately orthogonally attached to a base piece;

sliding a top piece over the prongs;

folding the prongs inwardly against a top surface of the top piece;

retaining the prongs against the top surface using vertically engaged locks; and folding latching covers over the prongs and retaining the latching covers against the prongs using second vertically engaged locks, wherein second spaced apart teeth on the latching covers engage first spaced apart teeth on the prongs.

8. A paper fastener comprising:

two prongs having outwardly facing longitudinally spaced apart teeth;

a base piece including base piece slots for attachment of the prongs to the base piece;

a top piece including:

a top surface;

at least two top piece slots for providing passage of the prongs through the top piece;

latching covers hingedly extend from ends of the top piece and including second longitudinally spaced apart teeth;

first vertically engaged locks for retaining the prongs against the top surface; and second vertically engaged locks for retaining the latching covers against the prongs, wherein the second longitudinally spaced apart teeth engage the outwardly facing longitudinally spaced apart teeth thereby laterally coupling the prongs to the latching covers, wherein the prongs may be passed through holes in the paper, though the top piece slots, and engaged into the locks, thereby sandwiching the paper between the base piece and the top piece.

9. The paper fastener of claim 8, wherein the first and the second vertically engaged locks include curved surfaces curving past center.

10. The paper fastener of claim 9, wherein the first and the second vertically engaged locks further comprise a multiplicity of spaced apart first and second vertically engaged locks.

11. The paper fastener of claim 10, wherein the outwardly facing longitudinally spaced apart teeth and the second longitudinally spaced apart teeth are saw tooth teeth.

12. The paper fastener of claim 10, wherein the latching covers are connected to the top piece by living hinges.

13. The paper fastener of claim 8, wherein the base piece slots comprise two pairs of base piece keyed slots, and wherein the prongs include flanged bases opposite tapered ends, wherein the prongs are attachable to the base by inserting the tapered ends through one of each of said two pairs of base piece keyed slots.

14. A paper fastener comprising:

a base piece;

two prongs which are approximately orthogonally extending from the base piece, the prongs having first longitudinally spaced apart teeth;

a top piece having a top surface, the top piece including top piece slots for providing passage of the prongs through the top piece and vertically engaged locks for retaining the prongs against the top surface;

latching covers extending from ends of the top piece, wherein the latching covers include second longitudinally spaced apart teeth;

second vertically engaged locks on the top surface of the top piece and wherein;

the latching covers are foldable over the top piece and engagable into the second vertically engaged locks; and the second longitudinally spaced apart teeth cooperate with the first longitudinally spaced apart teeth to laterally retain the prongs;

when the prongs may be passed through the holes in the paper, through the top piece slots and the top piece and engaged into the locks, thereby sandwiching the paper between the base piece and the top piece.

15. The paper fastener of claim 14, wherein the second vertically engaged locks include curved surfaces curving past center.

16. The paper fastener of claim 14, wherein the first longitudinally spaced apart teeth and the second longitudinally spaced apart teeth are saw tooth teeth.

17. The paper fastener of claim 14, wherein the latching covers are connected to the top piece by living hinges.

18. The paper fastener of claim 14, wherein the latching covers are hingedly connected to the top piece by pivot pins.

* * * * *